United States Patent [19]

Klembus et al.

[11] Patent Number: 4,684,188

[45] Date of Patent: Aug. 4, 1987

[54] ELECTRICAL CONNECTOR ASSEMBLY

[75] Inventors: Nancy M. Klembus, Newton Falls; Gary C. Detter, Berlin Center, both of Ohio

[73] Assignee: General Motors Corporation, Detroit, Mich.

[21] Appl. No.: 825,270

[22] Filed: Feb. 3, 1986

[51] Int. Cl.[4] ..... H01R 11/00

[52] U.S. Cl. ..... 439/587; 439/603

[58] Field of Search ..... 339/59 R, 59 M, 60 R, 339/60 M, 61 R, 61 M, 147 R

[56] References Cited

U.S. PATENT DOCUMENTS

| | | | |
|---|---|---|---|
| 3,937,545 | 2/1976 | Cairns et al. | 339/60 R |
| 4,214,802 | 7/1980 | Otani et al. | 339/60 M |
| 4,239,319 | 12/1980 | Gladd et al. | 339/147 R |
| 4,348,070 | 9/1982 | Simon | 339/59 R |
| 4,602,837 | 7/1986 | Sian et al. | 339/59 M |

FOREIGN PATENT DOCUMENTS

1833/80 2/1986 Ireland .

OTHER PUBLICATIONS

"Reinshagen ES-Kontakt 3"; pp. 1-17 (German).

*Primary Examiner*—Gil Weidenfeld
*Assistant Examiner*—Paula A. Austin
*Attorney, Agent, or Firm*—F. J. Fodale

[57] ABSTRACT

An electrical connector assembly has an insulator housing which includes a terminal holder and a housing cover for the terminal holder. The terminal holder supports elongated electrical terminals on a longitudinal platform which has a plurality of longitudinal fingers at the forward end and a plurality of partition walls at the rearward end which define terminal receiving channels which are associated with respective fingers. The elongated electrical terminals are laterally inserted into the terminal receiving channels and retained on the terminal holder by pairs of spaced, deflectable latch arms of the fingers. The housing cover has side walls and guide walls which prevent full insertion of a terminal holder having an improperly assembled electrical terminal and which hold the deflectable latch arms in terminal retaining positions when a terminal holder with properly assembled terminals is fully inserted in the housing cover.

4 Claims, 3 Drawing Figures

ELECTRICAL CONNECTOR ASSEMBLY

This invention relates generally to electrical connector assemblies and more particularly to electrical connector assemblies having an insulator housing which includes a terminal holder and a housing cover for the terminal holder.

Insulator housings of the above noted type are already known, for instance, from U.S. Pat. No. 2,332,846 granted to Walter E. Fladd on Oct. 26, 1943, for an Electrical Connector; U.S. Pat. No. 4,255,009 granted to Donald R. Clark on Mar. 10, 1981 for a Two Row Electrical Connector; German patent application No. 2,506,676 published Sept. 4, 1975 and German patent application No. 3,016,297 published Sept. 29, 1981.

The object of this invention is to provide an improved electrical connector assembly having an insulator housing of the above noted type.

An important feature of the invention is that the housing cover has a forward portion which is configured to prevent insertion of a terminal holder having an improperly seated electrical terminal or terminals.

Another important feature of the invention is that the housing cover has a forward portion which is configured so as to reinforce and maintain the terminal lock means of the terminal holder.

Still another feature of the invention is that the terminal holder may be used in conjunction with either male or female electrical terminals and with either electrical plug or socket connector assemblies.

Still another feature of the invention is that the electrical terminals are laterally insertable into the terminal holder thereby facilitating assembly of electrical terminals which are attached to small gauge wires.

Still another feature of the invention is that the electrical terminals are securely retained on the terminal holder in the properly oriented position.

Still yet another feature of the invention is that the electrical terminals are effectively isolated from each other.

Other objects and features of the invention will become apparent to those skilled in the art as the disclosure is made in the following detailed description of a preferred embodiment of the invention as illustrated in the accompanying sheets of drawing in which.

Figure 1:
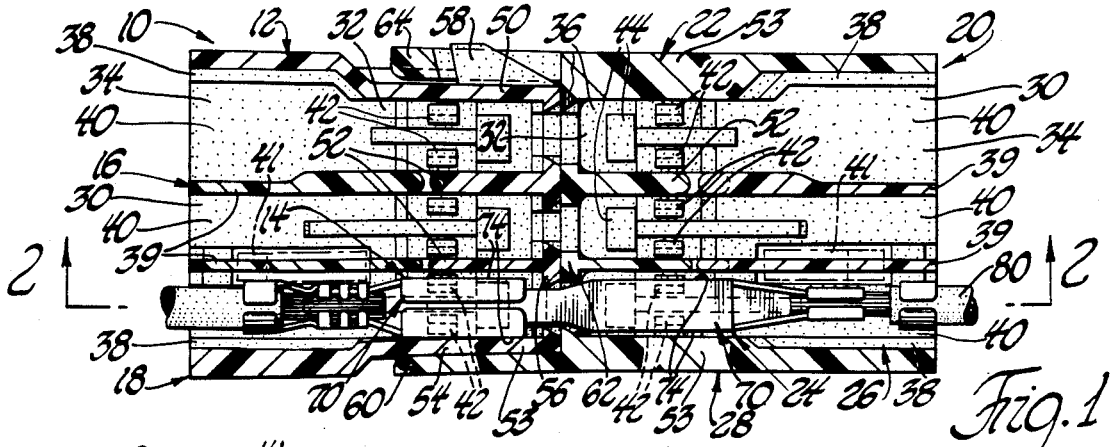
FIG. 1 is a longitudinal section of an electrical plug connector assembly in accordance with this invention, mated to an electrical socket connector assembly in accordance with this invention.
Figure 2:
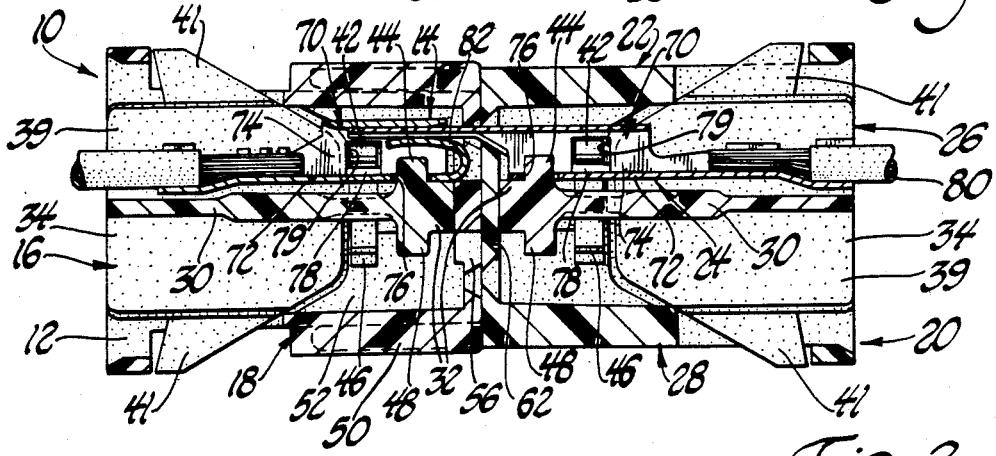
FIG. 2 is a section taken substantially along the line 2—2 of FIG. 1 looking in the direction of the arrows.

Referring now to the drawing, FIGS. 1 and 2 show an electrical plug connector assembly 10 in mating and locked engagement with an electrical socket connector assembly 20.

The electrical plug connector assembly 10 comprises an insulator housing 12 and a plurality of female terminals 14, in this instance six, only one of which is shown, which are housed in separate cavities of the insulator housing 12. The insulator housing 12, itself comprises a terminal holder 16 and a housing cover 18.

The electrical plug connector assembly 20 similarly comprises an insulator housing 22 and a plurality of male terminals 24, in this instance also six, which are housed in separate cavities of the insulator housing 22 only one being shown. The insulator housing 22, also comprises a terminal holder 26 which is identical to the terminal holder 16 and a housing cover 28 which has an internal configuration which is identical to that of the housing cover 18.

Figure 3:
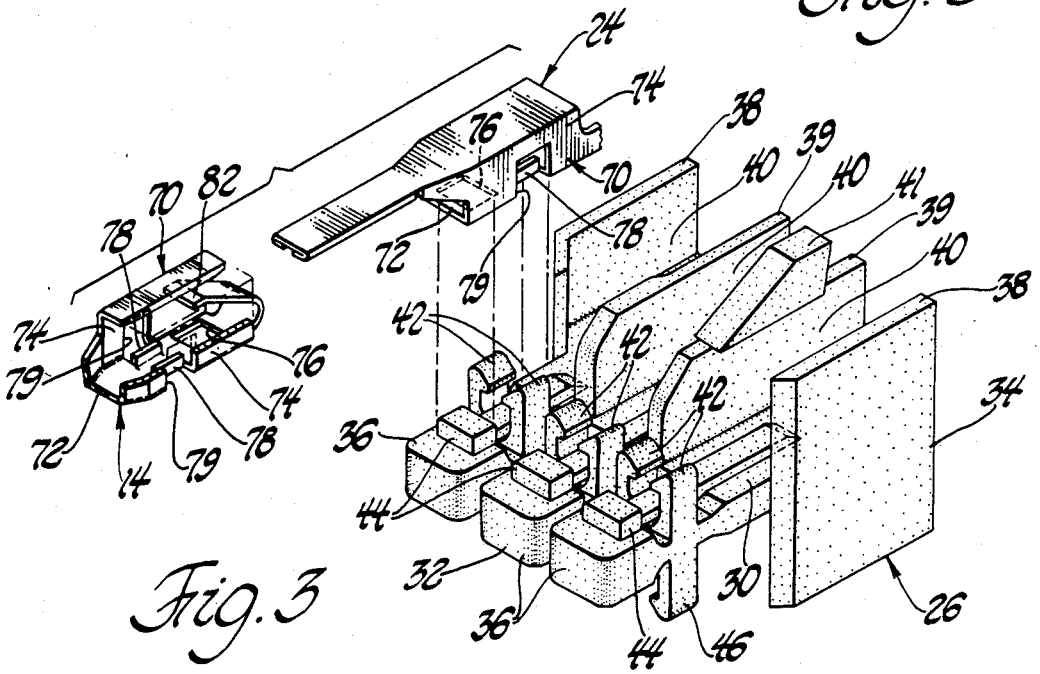
FIG. 3 is an exploded perspective view of various components of the electrical plug and socket connector assemblies shown in FIGS. 1 and 2.

The identical terminal holders 16 and 26 each comprise a longitudinal platform 30 which supports the elongated electrical terminals 14 or 24 and which has a forward portion 32 and a rearward portion 34. The forward portion 32 has three longitudinal fingers 36 and the rearward portion 34 has four partition walls—two end walls 38 and two interior walls 39. The partition walls 38 and 39 extend above and below the platform 30 to define six terminal receiving channels 40. Three of the channels 40 are above the platform 30 and associated with the upper surfaces of the three fingers 36, respectively. The other three channels are beneath the platform and associated with the respective lower surfaces. All the terminal receiving channels 40 are open opposite the platform 30 and shaped so that the elongated electrical terminals 14 or 24 are laterally insertable into the terminal receiving channels 40 as best illustrated in FIG. 3.

The interior walls 39 defining the channels 40 extend forwardly of the end walls 38 and one interior wall 39 has a thicker forward end as best seen in FIG. 1. The other interior wall 39, on the other hand, has projecting lock ramps 41 for retaining the terminal holder 16 or 26 in the housing cover 18 or 28 as shown in FIGS. 2 and 3.

Each finger 36 has a first pair of spaced, parallel, deflectable latch arms 42 which project upwardly and a first projection 44 on its upper surface for retaining a terminal 14 or 24 which is laterally inserted into the associated terminal receiving channel 40 above the platform 30. Each finger 36 also has a second pair of spaced, parallel, deflectable latch arms 46 which project downwardly and a second projection 48 on its lower surface for retaining a terminal 14 or 24 which is laterally inserted into the associated terminal receiving channel 40 beneath the platform 30.

The housing cover 18 has a forward or mating portion 50 which has two guide walls 52 between side walls 53. The guide walls 52 fit between the fingers 36 when the terminal holder 16 is disposed in the housing cover 18 as best shown in FIG. 1. One guide wall 52, the upper guide wall as viewed in FIG. 1, is thicker than the other. The two spaces between the three fingers 36 match the different thicknesses of the two guide walls 52 to insure that the terminal holder 16 is disposed in the housing cover 18 in the proper orientation.

The guide walls 52 and the side walls 53 of the forward portion 50 of the housing cover 18 are spaced apart so that as to prevent the cooperating pairs of deflectable latch arms 42 and 46 from spreading apart and thus the housing cover 18 provides means to hold each of the pairs of latch arms 42 and 46 in their undeflected terminal retaining positions shown in FIGS. 1, 2 and 3. These same walls also prevent assembly of terminal holders having improperly assembled terminals as explained below. The guide walls 52 form continuations of the interior partition walls 39 as shown in FIGS. 1 and 2. Thus, the terminal holder 16 and housing cover 18 form individual cavities which effectively isolate the terminals 14 from each other.

As indicated above, the housing covers 18 and 28 have substantially identical interiors and consequently, the housing cover 28 also has guide walls 52 and side walls 53 which cooperate with the terminal holder 26 in the same way. The difference between the housing covers 18 and 28 lies in the exterior shape at the forward or mating end to provide plug and socket connector assemblies, respectively.

More specifically, the mating end 50 of the housing cover 18 has a reduced plug end 54 which terminates in an apertured end face 56 and which includes a lock lug 58 which are commonly associated with plug connector assemblies. On the other hand, the forward or mating end of the housing cover 28 is characterized by a shroud 60, an apertured end face 62 which is recessed in the shroud 60 and a latch arm 64 formed in the shroud 60 for cooperative locking engagement with the lock lug 58.

The electrical socket connector assembly 20 is assembled by laterally inserting six male terminals 24 into the respective terminal receiving channels 40 of the terminal holder 26 as indicated in FIG. 3. Each male terminal 24 includes a locking area in the form of a box section 70 having a floor 72 and side walls 74. The floor 72 has a square hole 76 at the forward end and bent-up catches 78 at the rearward end which are disposed inwardly of windows 79 in the sidewalls 74. When the male terminal 24 is inserted into the channel 40, the square hole 76 fits over the projection 44 or 48 and the associated pair of lock arms 42 or 46 slide into the windows 79 and snap over the catches 78. This retains the male terminal 24 in the terminal holder 26 with the longitudinal axis of the male terminal 24 properly aligned on the longitudinal axis of the channel 40. The partition walls 38 and 39 at the rearward end of the terminal holder 26 also serve to prevent the crimp area of the male terminal 24 and the insulated conductor 80 to which it is attached from being used as a lever to force the male terminal 24 out of an aligned position.

The terminal holder 26 with six male terminals 24 retained in the channels 40 as described above is then inserted into the housing cover 28. As the terminal holder 26 is initially slid into the housing cover 28, the asymmetrically located lock ramps 41 serve as an indexing wall to insure assembly in the proper orientation. As the terminal holder 26 is slid further into the housing cover 28, the guide walls 52 enter the two slots between the three fingers 36 at the forward end of the terminal holder 26. If any of the male terminals 24 are not properly seated, the deflectable lock arms 42 or 46 for that terminal are bowed outwardly and interfere with the guide walls 52 preventing full insertion. Thus, the guide walls 52 do not permit assembly of the terminal holder 26 unless the male terminals 24 are all properly seated. When the guide walls 52 permit full insertion, the terminal holder 26 is retained in assembly with the housing cover 28 by the lock ramps 41 engaging a cooperating lock bar of the housing cover 28 as shown in FIG. 2.

The electrical plug connector assembly 10 is assembled in the same manner by laterally inserting six female terminals 14 into the respective terminal receiving channels 40 of the identical terminal holder 16. The female terminals 14 are retained in the channels 40 therein by a locking area which is substantially identical to that of the male terminal 24. More specifically, the socket 82 of the female terminal 14 also serves as the locking area which is in the form of a box section 70 having a floor 72 and side walls 74. As indicated above, the floor 72 has a square hole 76 at the forward end and bent-up catches 78 at the rearward end which are disposed inwardly of windows 79 in the sidewalls 74. When the female terminal 14 is inserted into the channel 40, the square hole 76 fits over the projection 44 or 48 and the associated pair of lock arms 42 or 46 slide into the windows 79 and snap over the recessed catches 78 as in the case of the male terminals 24.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector assembly having an insulator housing which includes a terminal holder and a housing cover for the terminal holder, comprising:

said terminal holder having a longitudinal platform for supporting elongated electrical terminals which has a forward portion and a rearward portion, said forward portion of the platform having a plurality of longitudinal fingers and said rearward portion of the platform having a plurality of partition walls which define terminal receiving channels which are associated with respective ones of the fingers and which are shaped so that the elongated electrical terminals are laterally insertable into the terminal receiving channels, each of said fingers having a pair of spaced, deflectable latch arms for retaining a terminal which is laterally inserted into an associated terminal receiving channel, and said housing cover having a forward portion which has means to hold the latch arms in terminal retaining positions, said means including a plurality of guide walls of the housing cover which fit between adjacent fingers of the terminal holder when the terminal holder is disposed in the housing cover.

2. An electrical connector assembly having a plurality of elongated electrical terminals disposed in an insulator housing which includes a terminal holder and a housing cover for the terminal holder, comprising:

said terminal holder having a longitudinal platform for supporting the elongated electrical terminals which has a forward portion and a rearward portion, said forward portion of the platform having a plurality of longitudinal fingers and said rearward portion of the platform having a plurality of partition walls which define terminal receiving channels which are associated with respective ones of the fingers, said terminal receiving channels being open opposite the platform and shaped so that the elongated electrical terminals are laterally insertable into and disposed in the terminal receiving channels, each of said elongated electrical terminals having a locking area which includes a floor and side walls, said floor having a hole and a pair of catches which are disposed inwardly of windows through the side walls, each of said fingers having a projection disposed in the hole of the floor and a pair of spaced, deflectable latch arms engaging the pair of catches for retaining the elongated electrical terminal which is disposed in the associated terminal receiving channel, said housing cover having a forward portion which has side walls and a plurality of guide walls which are spaced apart so as to interfere with a deflectable latch arm which is deflected outwardly so that a terminal holder having an improperly assembled elongated electrical terminal cannot be fully inserted into the housing cover, and said pluarlity of guide walls being spaced apart to fit between adjacent fingers and pairs of deflectable latch arms when the terminal holder is fully inserted in the housing cover to hold the deflectable latch arms in their terminal retaining positions.

3. The electrical connector assembly as defined in claim 2 wherein said plurality of guide walls include one guide wall which is thicker than another guide wall, and wherein said plurality of fingers define two spaces between adjacent fingers which match the thickness of said one guide wall and said another guide wall respectively to insure that the terminal holder is disposed in the insulator housing in the proper orientation.

4. An electrical connector assembly having an insulator housing which includes a terminal holder and a housing cover for the terminal holder, comprising:

said terminal holder having a longitudinal platform for supporting elongated electrical terminals which has a forward portion and a rearward portion, said forward portion of the platform having a plurality of longitudinal fingers and said rearward portion of the platform having a plurality of partition walls which define terminal receiving channels which are associated with respective ones of the fingers and which are shaped so that the elongated electrical terminals are laterally insertable into the terminal receiving channels, each of said fingers having a pair of spaced, deflectable latch arms for retaining a terminal which is laterally inserted into an associated terminal receiving channel, and said housing cover having a forward portion which has means to hold the latch arms in terminal retaining positions, said means including a plurality of guide walls of the housing cover which fit between adjacent fingers of the terminal holder when the terminal holder is disposed in the housing cover, said pair of guide walls including one guide wall which is thicker than another guide wall, and said plurality of fingers defining two spaces between adjacent fingers which match the thickness of said one guide wall and said other guide wall respectively to insure that the terminal holder is disposed in the insulator housing in the proper orientation.

* * * * *